US005231702A

United States Patent [19]

Masters

[11] Patent Number: 5,231,702

[45] Date of Patent: Aug. 3, 1993

[54] REUSABLE ARTICLE OF APPAREL FOR DECORATING POCKETS

[76] Inventor: Gayle Masters, 22 Jasmine Dr., Debary, Fla. 32713

[21] Appl. No.: 744,978

[22] Filed: Aug. 14, 1991

[51] Int. Cl.[5] ..... A41D 27/08; A41C 15/02

[52] U.S. Cl. ..... 2/244; 2/255; 2/279

[58] Field of Search ..... 2/206, 207, 244, 245, 2/246, 249, 250, 251, 256, 255, 257, 258, 259, 260; 24/563, 200, 49 R, 49 TS

[56] References Cited

U.S. PATENT DOCUMENTS

| | | | |
|---|---|---|---|
| 357,351 | 2/1887 | Welliver | 2/250 X |
| 1,631,398 | 6/1927 | Campbell | 2/279 |
| 1,719,244 | 7/1929 | Shirk | 2/250 |
| 2,163,710 | 6/1939 | Schockling | 2/279 X |
| 2,200,601 | 5/1940 | Grunwald | 2/279 X |
| 2,224,773 | 12/1940 | Shaulson | 24/200 |
| 2,269,511 | 1/1942 | Biederman | 2/279 |
| 2,293,562 | 8/1942 | Rosenthal | 24/200 |
| 2,513,884 | 7/1950 | Maurer | 2/279 |
| 2,738,515 | 3/1956 | Owen | 2/279 |
| 3,196,461 | 7/1965 | Erhardt | 2/279 |
| 3,280,488 | 10/1966 | Rubin | 2/249 |
| 3,512,182 | 5/1970 | Benzanilla | 2/279 |
| 3,619,817 | 11/1971 | Rockwell | 2/250 |
| 3,704,470 | 12/1972 | Beno et al. | 2/279 |
| 3,786,520 | 1/1974 | Harmon | 2/279 |
| 4,083,446 | 4/1978 | Schuchman, Sr. | 2/279 X |
| 4,309,799 | 1/1982 | Noda | 24/200 X |
| 5,025,534 | 6/1991 | Meijer | 24/200 X |
| 5,105,511 | 4/1992 | Shahin et al. | 24/198 |

FOREIGN PATENT DOCUMENTS

| | | | |
|---|---|---|---|
| 2431836 | 3/1980 | France | 2/279 |
| 1157309 | 7/1969 | United Kingdom | 2/279 |

*Primary Examiner*—Clifford D. Crowder
*Assistant Examiner*—Jeanette E. Chapman
*Attorney, Agent, or Firm*—Frank A. Lukasik

[57] ABSTRACT

A thin, relatively flat article of apparel to be used as a decorative insert for pockets. The insert has a smooth surface with a triangular end (20) and a straight end (36). All edges are rounded (38). The front, back, or either end of this insert may be displayed in a man's or woman's pocket. This insert is designed to be used alone or to support and secure decorative fabric (40) through multiple elongated openings (34). Right and left angled gripping slots (22 and 24) provide the option of displaying a second, contrasting fabric (50) for multicolored designs. Right and left extended tabs (30 and 32) and adjacent right and left straight gripping slots (26 and 28) prevent slippage of decorative fabrics (40 and 50).

3 Claims, 7 Drawing Sheets

REUSABLE ARTICLE OF APPAREL FOR DECORATING POCKETS

Background—Field of Invention

This invention relates to a reusable pocket insert which may be used alone or with decorative fabric.

Background Description of Prior Art

For many years men and women wearing suits, sport coats, blazers, coats, vests, tunics, blouses, dresses, or other types of apparel, have faced the problem of how to keep a handkerchief, scarf, or other piece of decorative fabric neatly in place in an outer breastpocket. Historically this decorative fabric has slipped out of sight, or to the side, or it has bulged into an unsightly lump inside the pocket. This problem has been particularly challenging since the advent of the silk or synthetic handkerchief, whose slippery nature has proved bothersome for the wearer who desires a neat appearance.

A number of years ago, dry cleaners and clothiers attempted to tackle this problem by furnishing customers with a "fake handkerchief". This item consisted of a portion of pre-folded white handkerchief sewn to a cardboard pocket insert. This makeshift solution presented numerous faults:

(a) This product did not provide for the use of a real handkerchief. It was strictly decorative and had no practical application as a handkerchief.

(b) The fake handkerchief could not be removed easily from the insert because it was sewn on. This restricted the wearer from laundering this decorative fabric without painstakingly removing the stitching, laundering the fabric, then sewing it back onto the cardboard insert.

(c) A distinct drawback was that this item lacked durability. Upon repeated use, the cardboard insert soon became limp, dog-eared, and bent out of shape. The wearer was hindered in attempts to change this insert repeatedly without causing wear and tear. Thus, the insert had a relatively short life.

(d) The wearer was unable to rearrange the handkerchief into a more creative or individual style since it was permanently attached to the cardboard insert.

(e) There was no easy method of separating the insert from the decorative handkerchief in order to change to another of an alternate size, type, color, pattern, design, shape, or texture.

(f) The restrictive size of this insert was often ineffective. The only solution for improper fit was to cut and/or pin the insert to fit the pocket. This was inconvenient and presented the possibility of personal injury or damage to fabrics from the use of pins or other fastening devices.

OBJECTS AND ADVANTAGES

The object of my invention is to overcome the foregoing problems by presenting a new concept. My product is a pocket insert which may be used repeatedly, either alone or with the addition of decorative fabric. Several objects and advantages of this invention are:

(a) to provide a pocket insert designed to support a wide variety of handkerchiefs or other decorative fabric;

(b) to provide a pocket insert from which it is easy to remove decorative fabric for laundering, pressing, reshaping, or separate use;

(c) to provide a durable pocket insert which will accommodate repeated use without appreciable deterioration;

(d) to provide a pocket insert with a variety of openings and tabs, enabling the user to create unique pocket designs with the use of decorative fabric;

(e) to provide a pocket insert with easy instructions for conveniently changing sizes, types, colors, patterns, designs, shapes, or textures of decorative fabric;

(f) to provide a pocket insert designed to fit standard pocket sizes, thus eliminating the inconvenience of using damaging pins, or other fastening devices;

(g) to provide a pocket insert that will secure and support decorative fabric after placing in a pocket;

(h) to provide an economical pocket insert available in numerous colors, materials, shapes, and styles, in sizes to accommodate many types of pockets;

(i) to provide a pocket insert which comfortably allows for upper body movements, yet holds attached fabric securely in place;

(j) to provide a pocket insert of contemporary style for complimenting both men's and women's attire for a variety of age groups;

(k) to provide a pocket decoration which may be pre-folded conveniently for use when traveling or at home;

(l) to provide a pocket insert to which multiple pieces of decorative fabric may be attached and blended for a stylish multicolored design;

(m) to provide a pocket insert with a smooth finish and rounded edges to prevent injury to the pocket or the wearer;

(n) to provide a pocket insert which is sufficiently attractive to be used without the addition of decorative fabric.

Further objects and advantages include providing a pocket insert that is neat in appearance and easy to use. The design of this insert encourages individual creative expression by providing suggestions for coordinating decorative fabric with matching ties or scarves. Additional objects and advantages will become apparent from a consideration of the ensuing descriptions and drawings.

DRAWING FIGURES

In the drawings, the figures illustrate a pocket insert with and without additional decorative fabric. A preferred application and two additional methods are illustrated.

Figure 11:
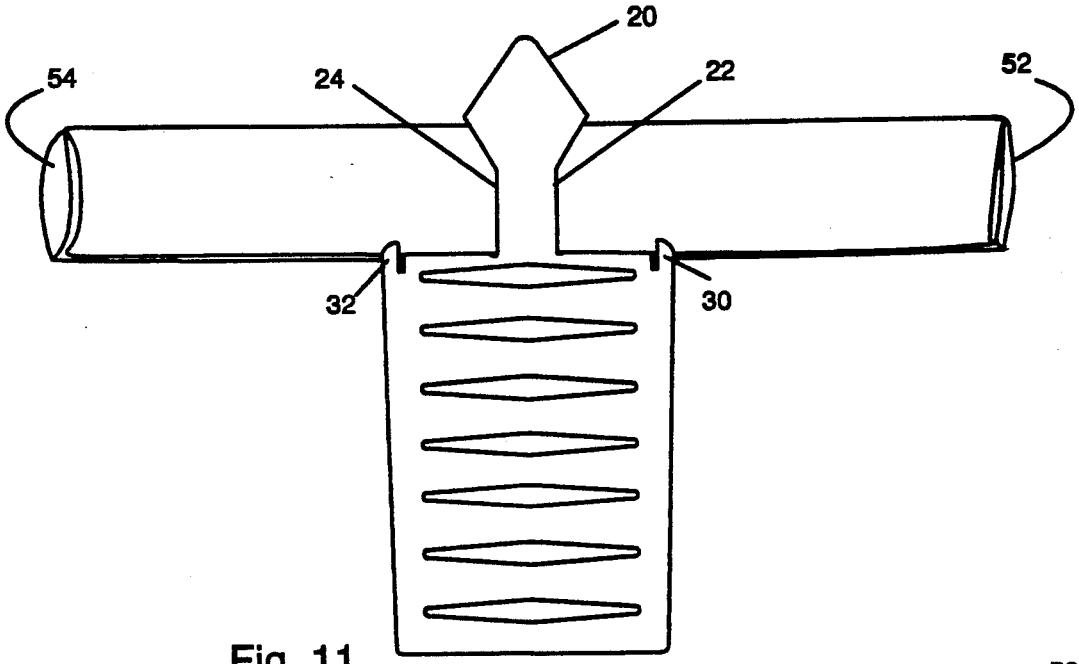

FIG. 11 begins a third application for use of decorative fabric.

Figure 12:
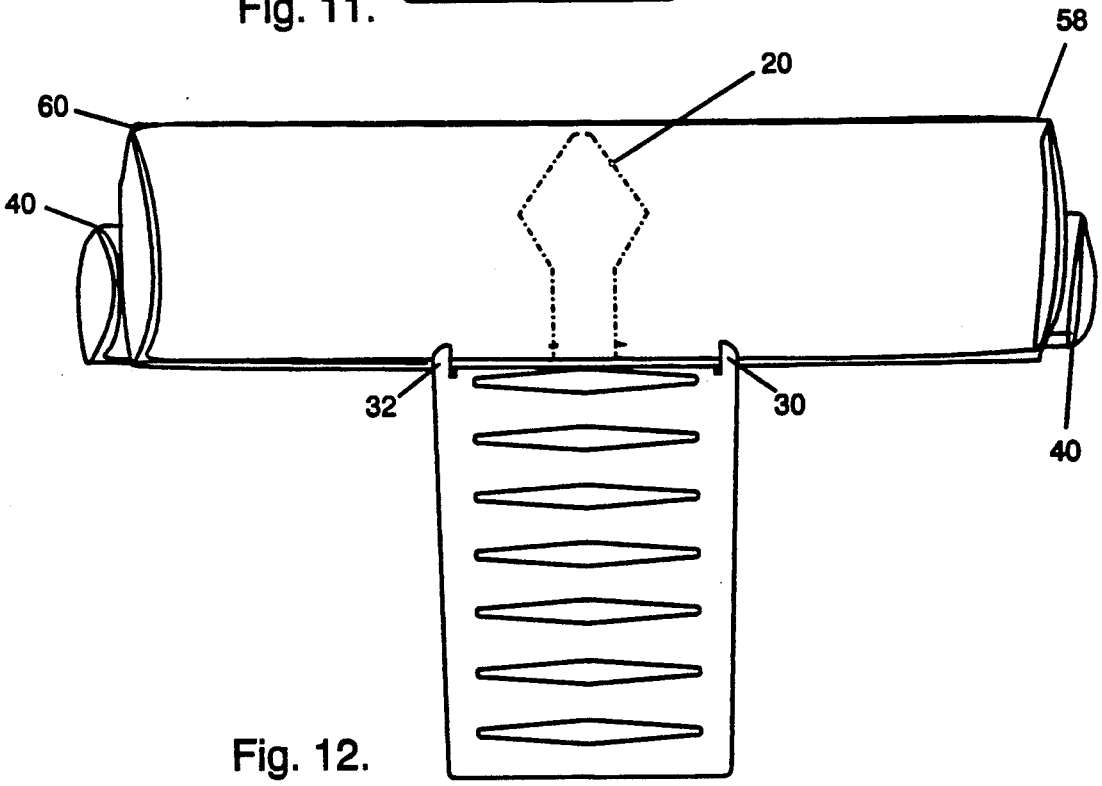
Figure 13:
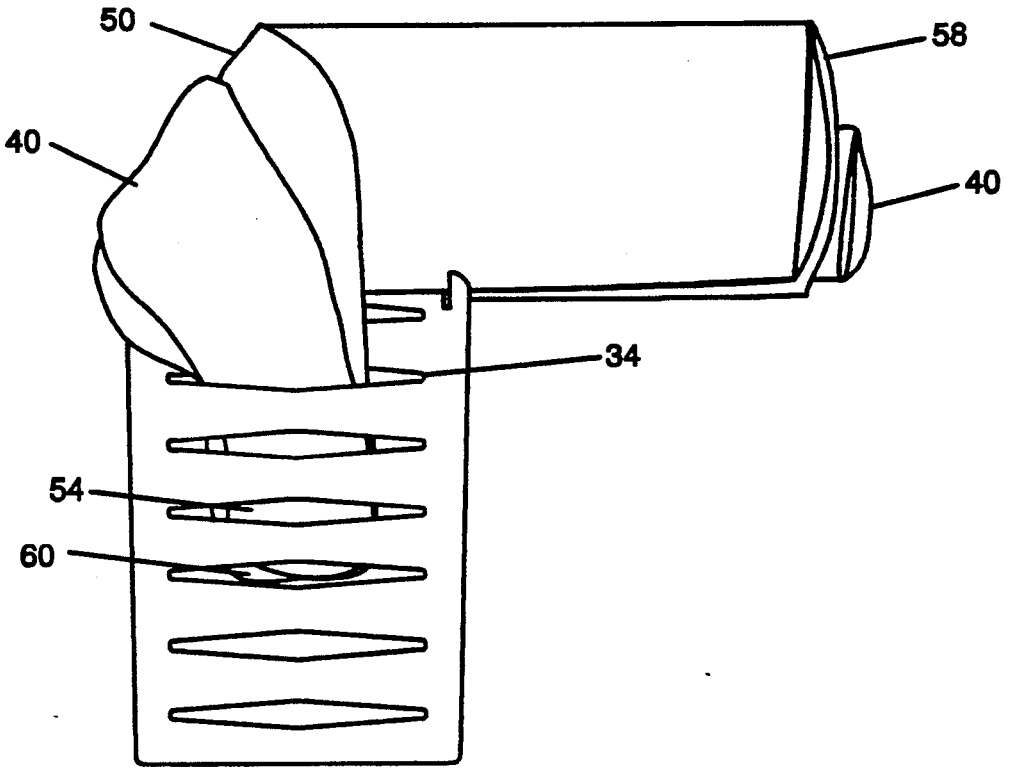
Figure 14:
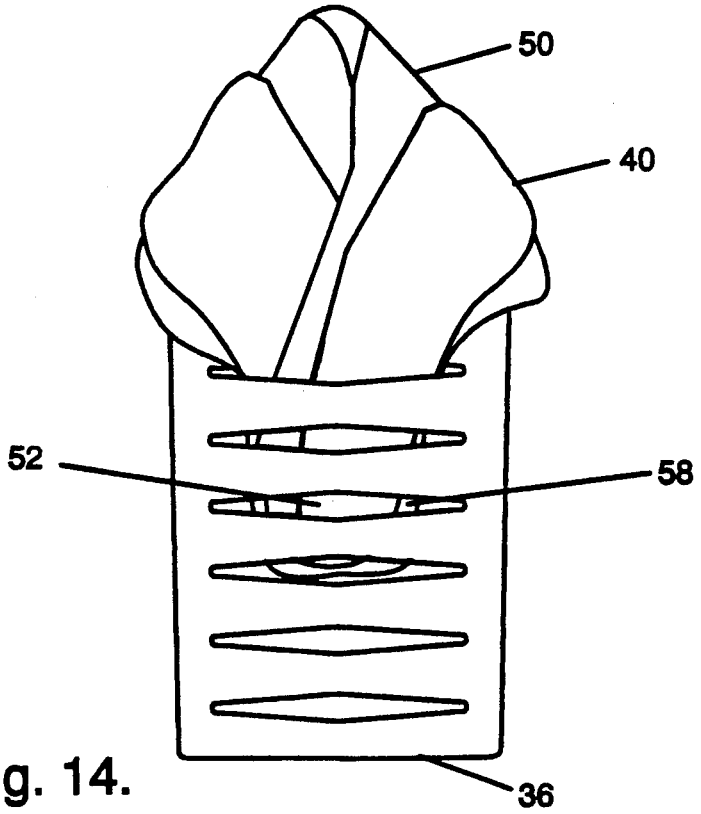

FIGS. 12 to 14 show the steps in weaving two pieces of decorative fabric through the insert.

REFERENCE NUMERALS IN DRAWINGS

20 triangular end
22 right angled gripping slot
24 left angled gripping slot
26 right straight gripping slot
28 left straight gripping slot
30 right extended tab
32 left extended tab
34 elongated openings (7)
36 straight end
38 rounded corners (all edges)
40 decorative fabric
42 top corner of decorative fabric
44 bottom corner of decorative fabric
46 right corner of decorative fabric
48 left corner of decorative fabric
50 contrasting fabric
52 edge-A of decorative fabric
54 edge-B of decorative fabric
56 pocket
58 edge-C of contrasting fabric
60 edge-D of contrasting fabric

DESCRIPTION—FIG. 1

Figure 1:
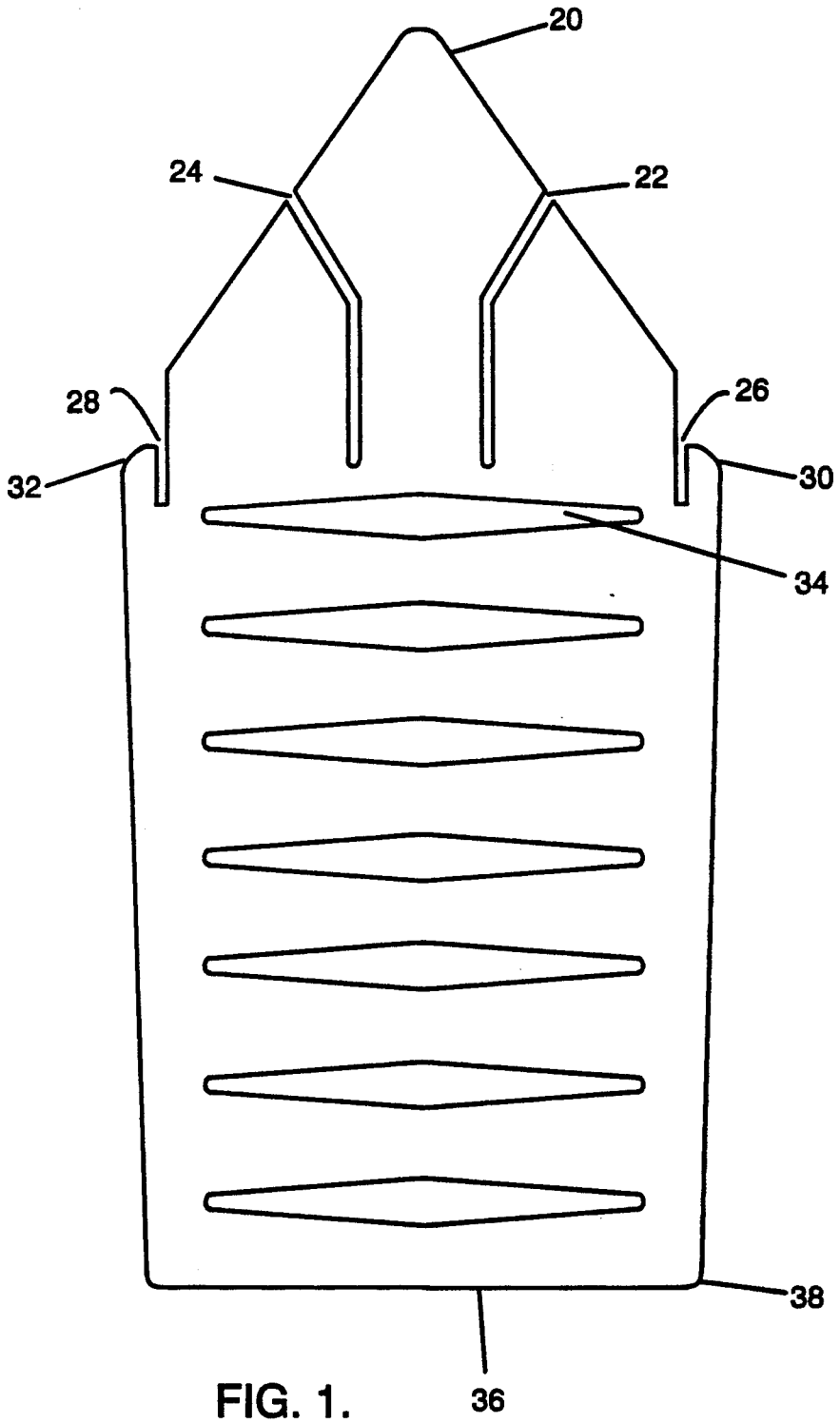
FIG. 1 shows various aspects of a pocket insert.

FIG. 1 shows a basic version of the invention. The pocket insert is comprised of a piece of plastic or other material which may be used repeatedly without being damaged. A smooth finish eliminates snagging of fabric. All ends and openings are rounded.

A typical wall thickness of 1.52 mm prevents bulkiness in the pocket. A typical length of 177.8 mm allows adequate display above a pocket of a standard depth of approximately 133.35–152.4 mm.

FIG. 1 illustrates a triangular end 20 and a straight end 36. Rounded corners 38 on all edges are designed to reduce damage to clothing and personal injury to the wearer.

Another feature of the insert is the use of a right extended tab 30 and a left extended tab 32. These contoured tabs are adjacent to a right straight gripping slot 26 and a left straight gripping slot 28. Tabs 30 and 32 typically have a length not to extend past a first of approximately seven elongated openings 34.

Right straight gripping slot 26 and left straight gripping slot 28 are located adjacent to the left and right extended tabs. These slots typically have a width of 1.52 mm.

A further distinguishing area shown in FIG. 1 is the use of elongated openings 34. These openings have a typical center width of 6.35 mm, tapering to a typical radius of 0.76 mm, with a typical length of 66.04 mm, forming a wedge-shaped opening through the part. Each elongated opening 34 is typically in a horizontal position, located vertically on approximately the center line of the insert, placing a first opening approximately 109.44 mm above straight end 36.

An important feature of this insert is the use of a right angled gripping slot 22 and a left angled gripping slot 24. Angled slots 22 and 24 have a typical slot width of 1.52 mm. These slots are vertical elbow-shaped openings which extend toward straight end 36, typically terminating just above the first of elongated openings 34.

OPERATIONS—FIGS. 1, 2, 3, 4, 5, 6

The insert may be used alone, as in FIG. 1.

Figure 2:
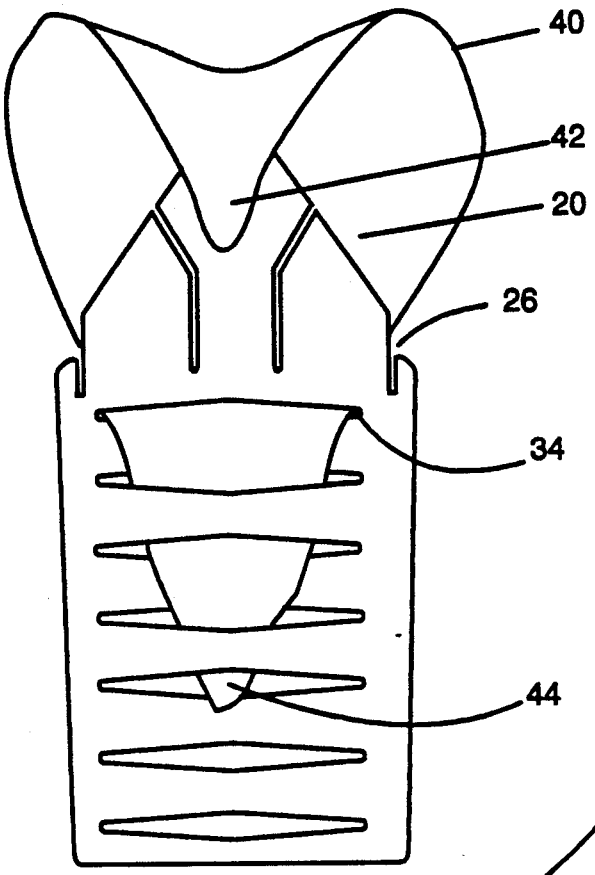
FIGS. 2 to 5 show the insert with a piece of decorative fabric woven through various openings in the pocket insert.
Figure 3:
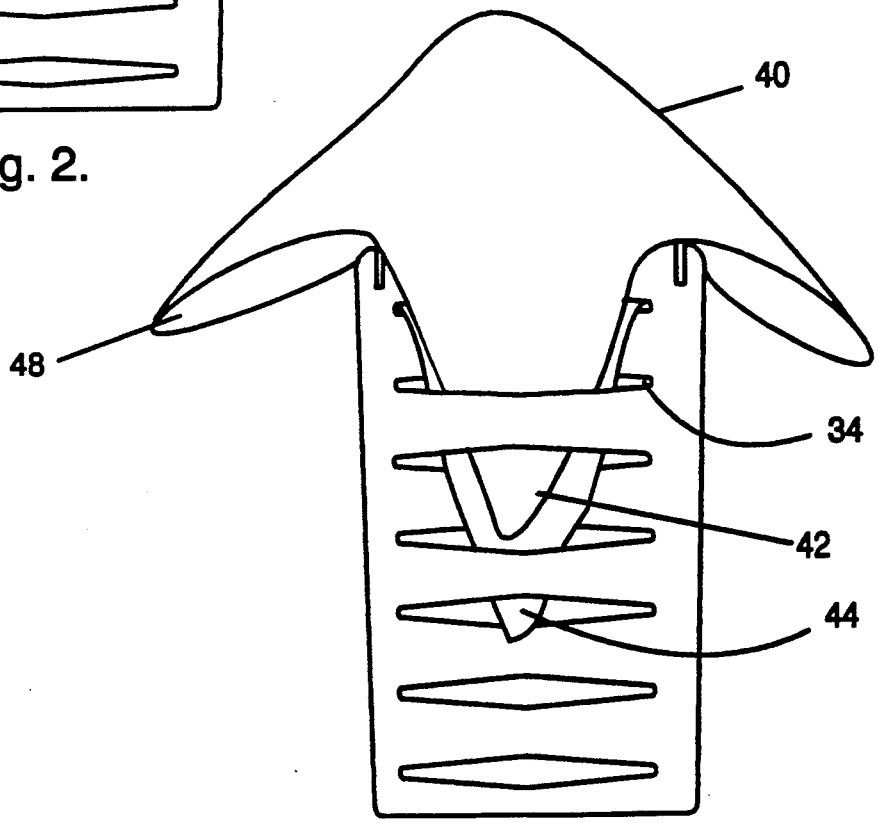
Figure 4:
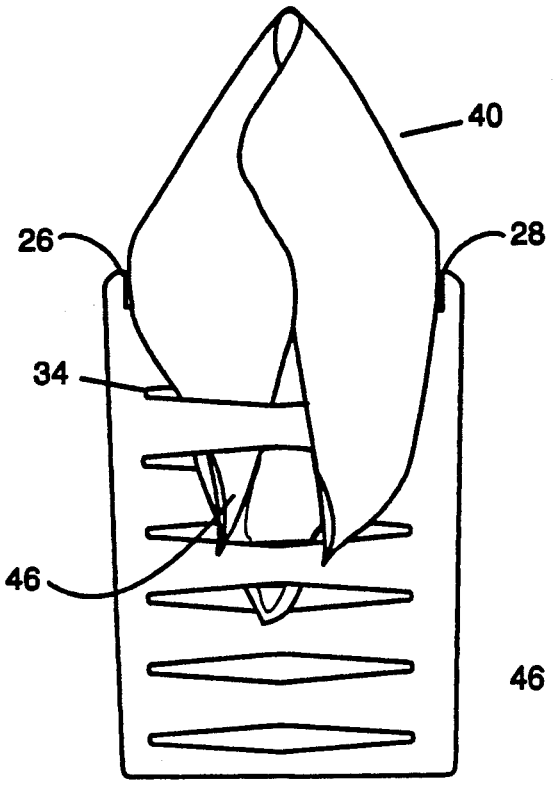
Figure 5:
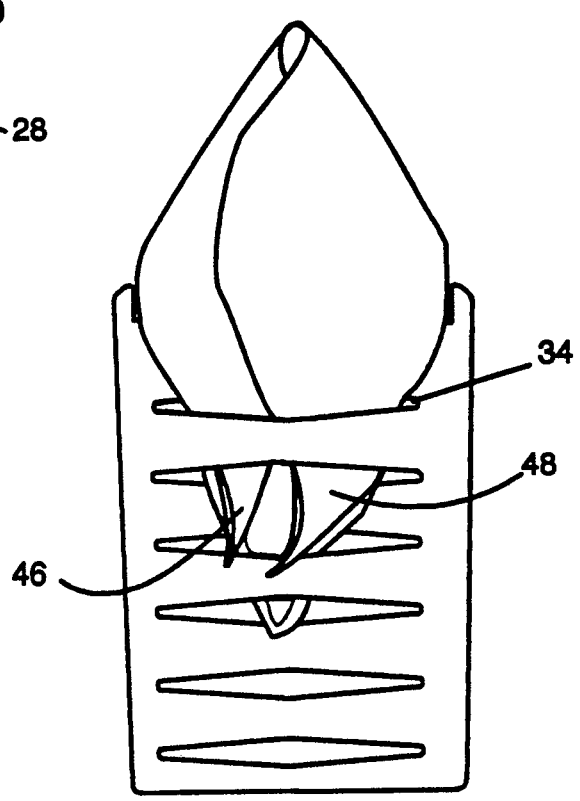
Figure 6:
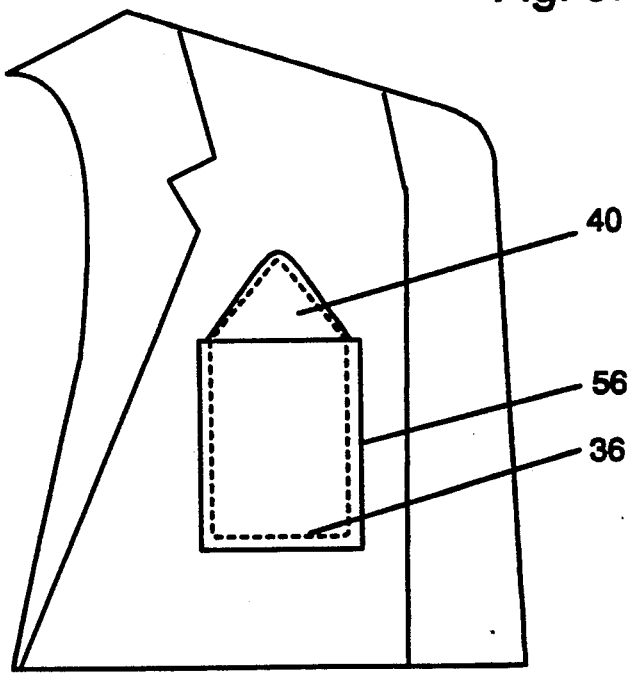
FIG. 6 shows the insert placed in a pocket with the fabric-covered triangular end displayed above the top of the pocket.

FIGS. 2 to 6 show the steps in attaching a decorative fabric to the insert. FIG. 2 illustrates the introduction of a decorative fabric 40. To attach the fabric, first lay it out flat. Beginning with the first of elongated openings 34, weave a bottom corner 44 of the fabric in and out through several of the openings. Fold a top corner 42 of the fabric up and over triangular end 20 from the far side of the insert. FIG. 3 shows corner 42 pulled down to cover the triangular end of the insert, then woven in the same in-and-out repetition through several elongated openings 34. This view further shows a right corner 46 and a left corner 48 loosely extended on each side of the insert. Illustrated in FIG. 4 (back view), right and left corners 46 and 48 have been pulled to the back of the insert through straight slots 26 and 28. Corner 46 has been securely woven in and out through the first of elongated openings 34. Corner 48 is hanging loose. FIG. 5 (back view) shows corner 48 has also been secured through the first of elongated openings 34, over corner 46. FIG. 6 indicates the appearance of a pocket. Straight end 36 of the insert, with attached fabric, has been placed in pocket 56.

The above operation describes the preferred use of this invention; however, many other variations are possible. The following descriptions are examples of some additional applications of this invention.

OPERATION—FIGS. 7, 8, 9, 10

Figure 7:
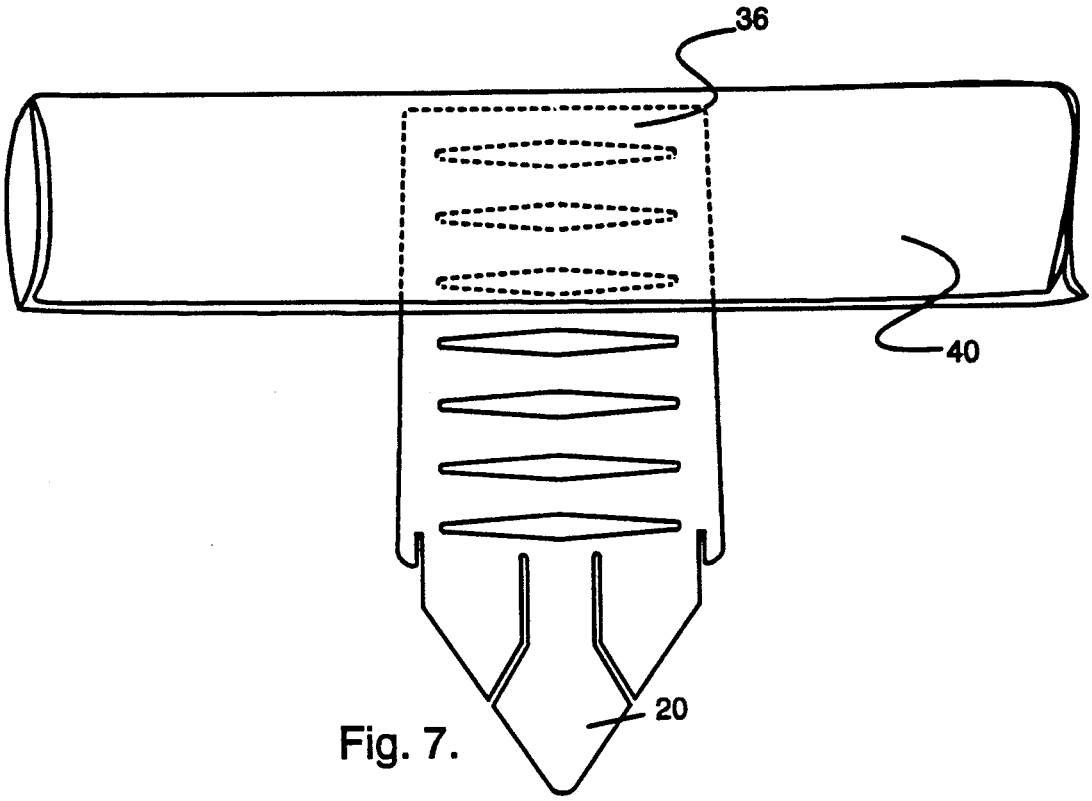
FIGS. 7 to 9 show a method of attaching a decorative fabric to the opposite end of the insert.
Figure 8:
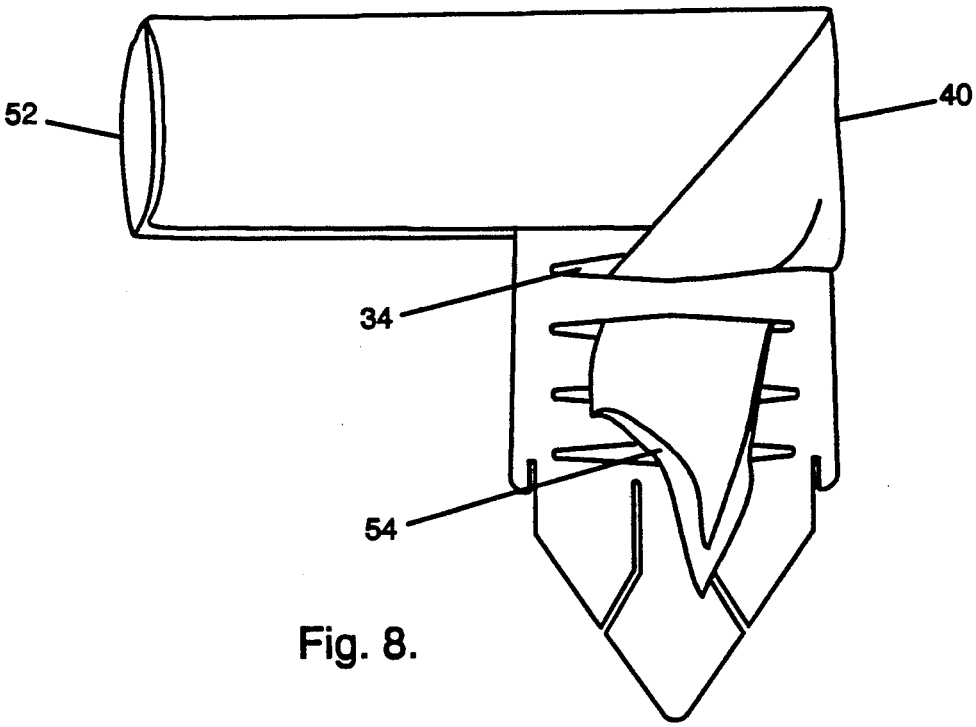
Figure 9:
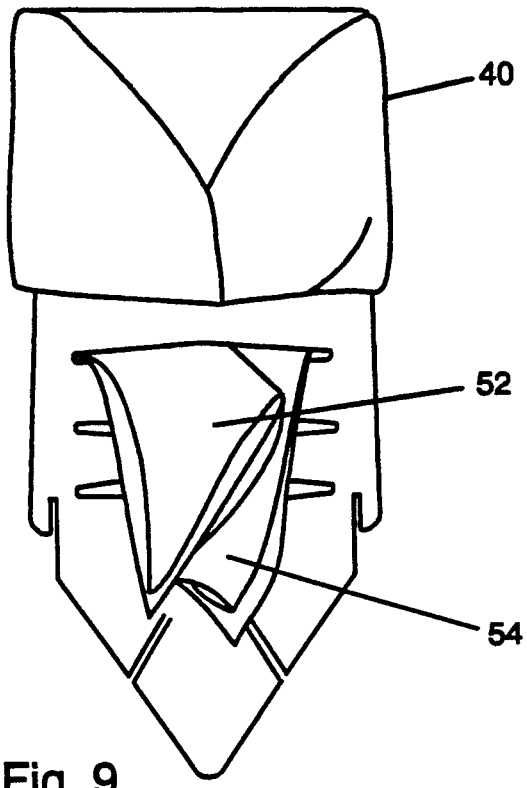
Figure 10:
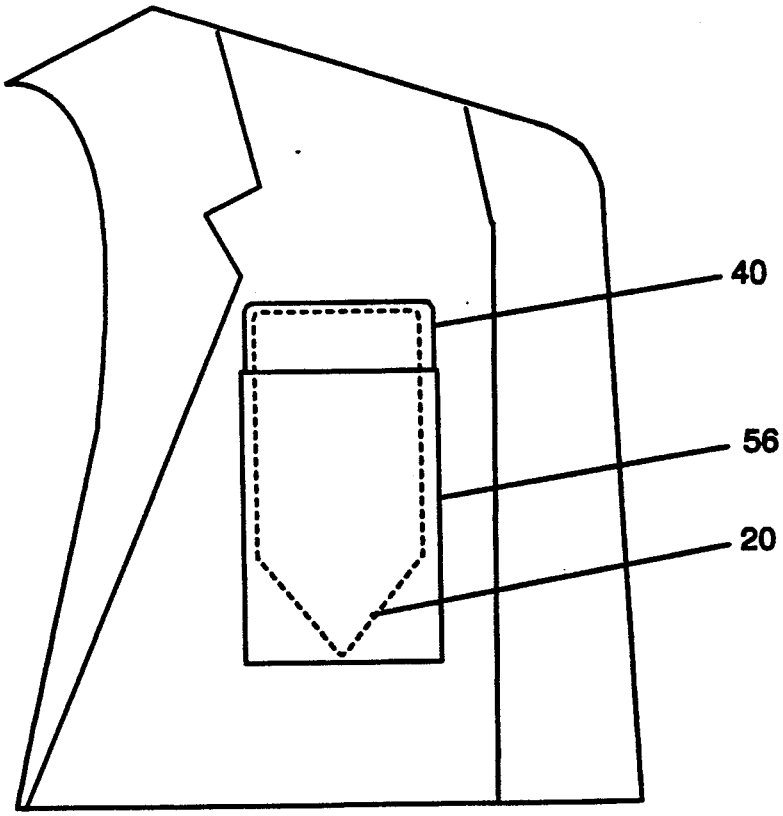
FIG. 10 shows the insert placed in a pocket with the fabric covered straight end displayed above the top of the pocket.

A second application utilizes the straight end of the insert as support for decorative fabric, as illustrated in FIGS. 7 to 10. FIG. 7 (back view) shows the first step. Fold a piece of decorative fabric 40 in lengthwise folds, forming one pleated edge and one smooth edge. The folded fabric will be approximately two inches wide. Locate the approximate middle of decorative fabric 40 and slide straight end 36 of the insert between the open side of folds. FIG. 8 (back view) shows an edge-B 54 of fabric 40 woven in and out through elongated openings 34. FIG. 9 (back view) indicates an edge-A 52 of decorative fabric 40 woven in a similar manner, over fabric edge 54. FIG. 10 illustrates a final view of this application. Triangular end 20 of the insert, with attached fabric 40, has been placed in pocket 56.

OPERATION—FIGS. 11, 12, 13, 14

FIGS. 11 to 14 follows the steps in a third application by creating a multicolored pocket display. This involves the use of two pieces of decorative fabric. FIG. 11 begins with a piece of decorative fabric 40, folded as described for FIG. 7. Working with the triangular end of the insert, hold the fabric near edge 52. Feed it through left angled gripping slot 24, behind triangular end 20, then through right angled gripping slot 22. Fabric edges 52 and 54 extend on either side of tabs 30 and 32. Adjust the edges of the fabric to equal lengths on either side of the tabs. FIG. 12 shows the introduction of a second piece of decorative fabric in a contrasting color. Fold a contrasting fabric 50 in a similar manner to that described for FIG. 11. Without disturbing the position of decorative fabric 40, grasp contrasting fabric 50 near an edge-C 58 and feed behind right extended tab 30, in front of triangular end 20, then behind left extended tab 32. Edges-C 58 and D 60 extend on either side of tabs 30 and 32. Adjust the edges of contrasting fabric 50 to equal lengths. FIG. 13 depicts working with both decorative fabric 40 and contrasting fabric 50. Holding both fabrics together, as if one piece of fabric, weave edges 54 and 60 in and out through elongated openings 34, securing both edges. FIG. 14 repeats the operation in FIG. 13, this time weaving edges 52 and 58 through the elongated openings, over the edges already secured. All edges of the decorative fabric and the contrasting fabric are secured in the elongated openings. Contrasting fabric 50 is wrapped around decorative fabric 40, with fabric 40 visible above and below. This completes the steps in FIG. 11, FIG. 12, and FIG. 13, creating a multicolored pocket display such as black and white. Straight end 36 is now ready for placing in a pocket. Either front or back of the combined fabrics may be displayed.

SUMMARY, RAMIFICATIONS, AND SCOPE

As noted above, this pocket insert may be used easily with or without decorative fabric. Such fabric may be removed for independent use of fabric or insert. Decorative fabric may be attached to either end of the insert. Likewise, either the front or back may be displayed above a pocket. Further, this invention has additional advantages in that it is made for use with a wide variety of handkerchiefs or other decorative fabrics, which conveniently may be attached in advance;

it has smooth corners and openings which contribute to ease in removing decorative fabric for laundering, reshaping, or using separately;

it is durable for long life, yet flexible and lightweight enough to permit free movement without disturbing attached decorative fabric;

it provides a variety of openings and tabs which encourage the user to create unique designs with multiple pieces of decorative fabric, or fabrics that match neckties, scarves, hats, or other items of apparel;

it saves time for the consumer by providing instructions for conveniently changing decorative fabrics to others differing in size, type, color, pattern, shape or texture;

its smooth edges, rounded corners, and convenient size relieve the user from concern over personal injury or damage to expensive fabrics caused by using pins for fitting into pockets or securing fabric into place;

its contemporary design offers men and women of many ages the advantage of stylishly displaying this insert as an attractive accessory without the use of additional decorative fabric.

Although the above specifications describe one particular type of pocket insert, this description should not be construed as limiting the scope of this invention. Many alternative forms are possible. For example, the insert could have other end shapes, such as rounded, flower shaped, star shaped, with higher or lower angles, or other shapes, or changed in some other dimension or in number. The elongated openings could be single, double, or triple in configuration or might vary in length, width, or shape. The elongated openings might also be placed in a vertical, diagonal, or other configuration, or changed in some other dimension or in number. The extended tabs might be longer, shorter, wider, narrower, curved, looped, angled, or changed in some other dimension or in number. The angled gripping slots could be wider, narrower, vertical, horizontal, curved, angled in another manner, or changed in some other dimension or in number. The insert could be made of other types of plastic, metal, cardboard, fabric, or other materials, and it could be made in various colors, sizes, thicknesses, finishes, textures, or changed in some other manner. The dimensions of the insert could be modified for marketing to a specific target group, such as men, women, children, teenagers, or others. The dimensions might also be specified for various types of pockets, such as those on shirts, sweaters, sweatshirts, jogging suits, skirts, shorts, hip pockets on slacks, change pockets on jeans, decorative pockets in boots, shoes, handbags, hats, or other types of apparel.

Thus, the scope of the invention should be determined by the claims and their legal equivalents, rather than by the examples given.

I claim:

1. An article of apparel to be used as an insert in the pockets of men's and women's clothing, whereby decorative fabric may be supported and secured, comprising:

a relatively flat, thin piece of material of sufficient flexibility and size to fit into said pockets and extend above the top line of said pockets, and including;

a first end with a triangular configuration and an opposite end being a straight edge, said first end having two vertical elbow-shaped slots located on either side of an approximate vertical center line in said first end;

a plurality of openings to be used for attaching said decorative fabric to said material, said openings are elongated in shape, horizontally oriented, and roughly wedge-shaped, with a wider void in the center of the wedge, tapering to narrower ends at right and left; and a plurality of tabs to be used for entwining said decorative fabric and for guiding said fabric through said openings in said material.

2. An article of apparel according to claim 1 wherein said tabs are rectangular in shape and are located on both sides of said material at an approximate vertical center line, and positioned at an approximate base of said article.

3. An article of apparel to be used as an insert in the pockets of men's and women's clothing, whereby decorative fabric may be supported and secured, comprising:

a relatively flat, thin piece of material of sufficient flexibility and size to fit into said pockets and extend above the top line of said pockets, and including;

a first end with a triangular configuration and an opposite end being a straight edge, said first end having two vertical elbow-shaped slots located on either side of an approximate vertical center line in said first end;

a plurality of openings to be used for attaching said decorative fabric to said material, said openings are elongated in shape, horizontally oriented, and roughly wedge-shaped, with a wider void in the center of the wedge, tapering to narrower ends at right and left;

at least two rectangular tabs to be used for entwining said decorative fabric and for guiding said fabric through said openings in said material, said tabs being located on both sides of said material at an approximate vertical center line, and positioned at the approximate base of said article, an outer edge of one tab formed by a right edge of said material and an inner edge of the other tab forms a left edge of the material.

* * * * *